US006442883B1

(12) United States Patent
Waterman et al.

(10) Patent No.: US 6,442,883 B1
(45) Date of Patent: Sep. 3, 2002

(54) SINGLE CAM OPERATED ATTACHMENT DEVICE

(75) Inventors: Michael D. Waterman, Chandler; Curtis B. Keepers, Tempe; Gary A. Wannagot, Mesa; Clifford J. Connors, Tempe, all of AZ (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 09/528,890

(22) Filed: Mar. 20, 2000

(51) Int. Cl.[7] ..... F41G 1/38
(52) U.S. Cl. ..... 42/124
(58) Field of Search ..... 42/124, 140

(56) References Cited

U.S. PATENT DOCUMENTS

| | | | | | |
|---|---|---|---|---|---|
| 3,877,166 | A | * | 4/1975 | Ward | 42/1 |
| 4,205,473 | A | * | 6/1980 | Wilson | 42/1 |
| 4,742,636 | A | * | 5/1988 | Swan | 42/101 |
| 4,845,871 | A | | 7/1989 | Swan | 42/101 |
| 4,890,407 | A | * | 1/1990 | Nichols | 42/100 |
| 5,086,566 | A | * | 2/1992 | Klump | 33/247 |
| 5,276,988 | A | | 1/1994 | Swan | 42/101 |
| 5,533,292 | A | * | 7/1996 | Swan | 42/140 |
| 5,570,529 | A | * | 11/1996 | Amelino | 42/101 |
| 5,641,147 | A | * | 6/1997 | Pena | 248/688 |
| 5,680,725 | A | * | 10/1997 | Bell | 42/101 |
| 5,787,630 | A | * | 8/1998 | Martel | 42/101 |
| 5,881,486 | A | * | 3/1999 | Bilgeri et al. | 42/75.02 |
| 6,073,895 | A | * | 6/2000 | Isbell et al. | 248/201 |

OTHER PUBLICATIONS

10 Various Photographs of Mount Assembly, Weaver Rail, Litton EOS P/N 241565–100.
8 Various Photographs of TWS Rail Grabber, US Government P/N 80063–A3170324.

* cited by examiner

*Primary Examiner*—Charles T. Jordan
*Assistant Examiner*—Denise J Buckley
(74) *Attorney, Agent, or Firm*—Marsteller & Associates, P.C.

(57) ABSTRACT

A fastening device (F) with first (16) and second sides (30) attaches a first device (10) to a mounting rail (12) of a second device (14). A top section (44) for mounting the first device extends from the first or second sides. The sides are adapted to removably clamp about the rail. A clamping member (46) extends between the first and second sides. An extended end (48) of the clamping member extends through the first side, and an opposing end (50) is coupled with the second side. The clamping member extended portion (48) is movably coupled to a single cam member (56) operably mounted with the first side for drawing the sides closer together into a clamping position (58) to mate the sides with the rail.

14 Claims, 4 Drawing Sheets

SINGLE CAM OPERATED ATTACHMENT DEVICE

BACKGROUND OF THE INVENTION

1. Technical Field

The invention relates to the field of attachment means, and more particularly to a mount for attaching devises to a weapons mount such as one meeting the US MIL-STD-1913 standard or other type of railing.

2. Background Art

Known systems to attach or fasten various devices to weapons rails include at least 3 different types. A first known type includes a mount that uses two cam operated locking mechanisms, one forward and the other aft. A second type of attachment means includes a mount that uses a machine screw operated locking mechanism, either single or double with one forward and the other aft. A third type of known attachment means is a variation of the second: a mount that uses a torque limiting device in or under the knob of the machine screw(s).

The first type of mount has a two-cam locking method that locks one side of the mount to a weapon rail first and then locks the second side. The sequence of locking may cause many problematic mechanical effects. For example when the first locking mechanism has secured one side, the mount is horizontally rotated relative to the weapon rail. The smaller the distance between the locks, the more relative rotation there will be. When the second lock is activated, this works against the first lock causing it to slip or spin. Slipping of the first lock continues until the second is completely secured. Now the second lock is applying a clamping force to the weapon rail while the first lock is applying both a clamping force and a torque.

The inherent problem with the above mentioned mounting system is consistency. The torque applied by the first lock is sustained by friction and friction can change with weather conditions or the introduction of foreign materials. For example, if one were to attach the mount to the weapon rail when it is dry, and then the mechanism gets wet, the torque holding fiction may be reduced and the mount will shift.

The above problem can negatively influence bore-sight retention of the sight to the weapon. If the recoil-stop is not perpendicular with the weapon rail when tightened, the recoil of the weapon during firing may shift the mount on the rail until this perpendicularity has been established.

With the two-lock system, the user must remember to always tighten the locks in the same sequence each time. If bore-sight is established after securing the forward lock first, then the forward lock must always be secured first to maintain bore-sight retention.

This type of two-lock mounting system may also use a sheetmetal guard between the cam and the weapon rail; one must place one specific side of the mount on the rail and rock the mount into position. If this not performed properly, the sheetmetal guard gets trapped between the mount and the weapon rail causing improper installation of the mount and possibly permanently deform the sheetmetal guard.

An additional disadvantage to the known two-lock system is the short and straight levers that operate the cam locks. The straightness of the levers can make it difficult to grab because they are too close to the mount. The short length of the levers does not provided adequate mechanical advantage, and is difficult to lock and unlock.

Exemplary of the two-cam locking method are U.S. Pat. Nos. 5,276,988 and 4,845,871.

The second type of known mount uses one or two machine screws that operate the locking mechanism. When two machine screws are used, this second system has all the same problems as the first. However, it does not have the problem of a lever that is hard to reach or having a lack of mechanical advantage.

An additional disadvantage to the machine screw operated locking mechanism system, whether single or double, is the time required to secure the mount and inconsistent loading. Instead of the locking mechanism working by quick acting cams, a machine threaded screw is turned. This method can be very time consuming. It is also hard to hand torque a screw to provide a consistent clamping force. In some cases a torque limiting wrench has been supplied with the mount.

An example of this second type of mounting system is the Mount Assembly, Weaver Rail; Litton EOS P/N 241565-100.

The torque limiting lock mounting system is intended to address the inconsistent loads. The locking mechanism is a screw type, but uses a torque limiting mechanism to keep the clamping load consistent. This torque limiting mechanism may have a noisy operation, and is not desirable when silence is required.

The mechanism protrudes to the side of the mount, and is susceptible to damage during accidental impact, such as when dropped or accidental contact with any foreign objects.

The inconsistent load issue is not adequately addressed by these torque limiting mechanisms; the user can greatly increase the resultant torque by applying an inward axial load while turning the knob. Also, time required to operate the screw mechanisms in not addressed.

An example of this third type of known mounting system is the TWS Rail Grabber, U.S. Government P/N 80063-A3170324.

While the above cited references introduce and disclose a number of noteworthy advances and technological improvements within the art, none completely fulfills the specific objectives achieved by this invention.

DISCLOSURE OF INVENTION

The purpose of the present invention is to provide a mount that secures a sighting or viewing system to the mounting rail of a weapon, and has an adjustable support to help stabilize the sight.

In accordance with the present invention, a fastening device for attaching a selected first device to a mounting or mating rail member of a second device includes a first side member that has an interior and an exterior surface, upper and lower longitudinal edges, and first and second edges. Similarly, a second side member has an interior and an exterior surface, upper and lower longitudinal edges, and first and second edges. A top section extends between the first or second sides near the respective upper longitudinal edges. The top section is adapted to mount the first device.

The first and second sides are also adapted to clamp about at least a portion of the mating rail member with the mating rail member being removably secured between the interior surfaces of the first and second sides. A clamping rod or member extends between the first and second sides. The clamping member has an extended end and an opposing engaged end with the extended end of the clamping member having a portion of the clamping member extending through the first side. The engaged end of the clamping member includes a portion of the clamping member that is coupled with the second side.

The extended portion of the clamping member is movably coupled to a single cam member that is operably mounted with the first side for drawing the first and second sides closer together into a clamping position. When the present fastening device is in the clamping position the first and second side members will mate with the desired mating rail and secure the fastening device to the mounting rail.

Advantages of the present invention are: single cam operation; support mechanism; and speed, ease, and consistency of installation.

These and other objects, advantages and features of this invention will be apparent from the following description taken with reference to the accompanying drawings, wherein is shown the preferred embodiments of the invention.

BRIEF DESCRIPTION OF THE DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Figure 4:
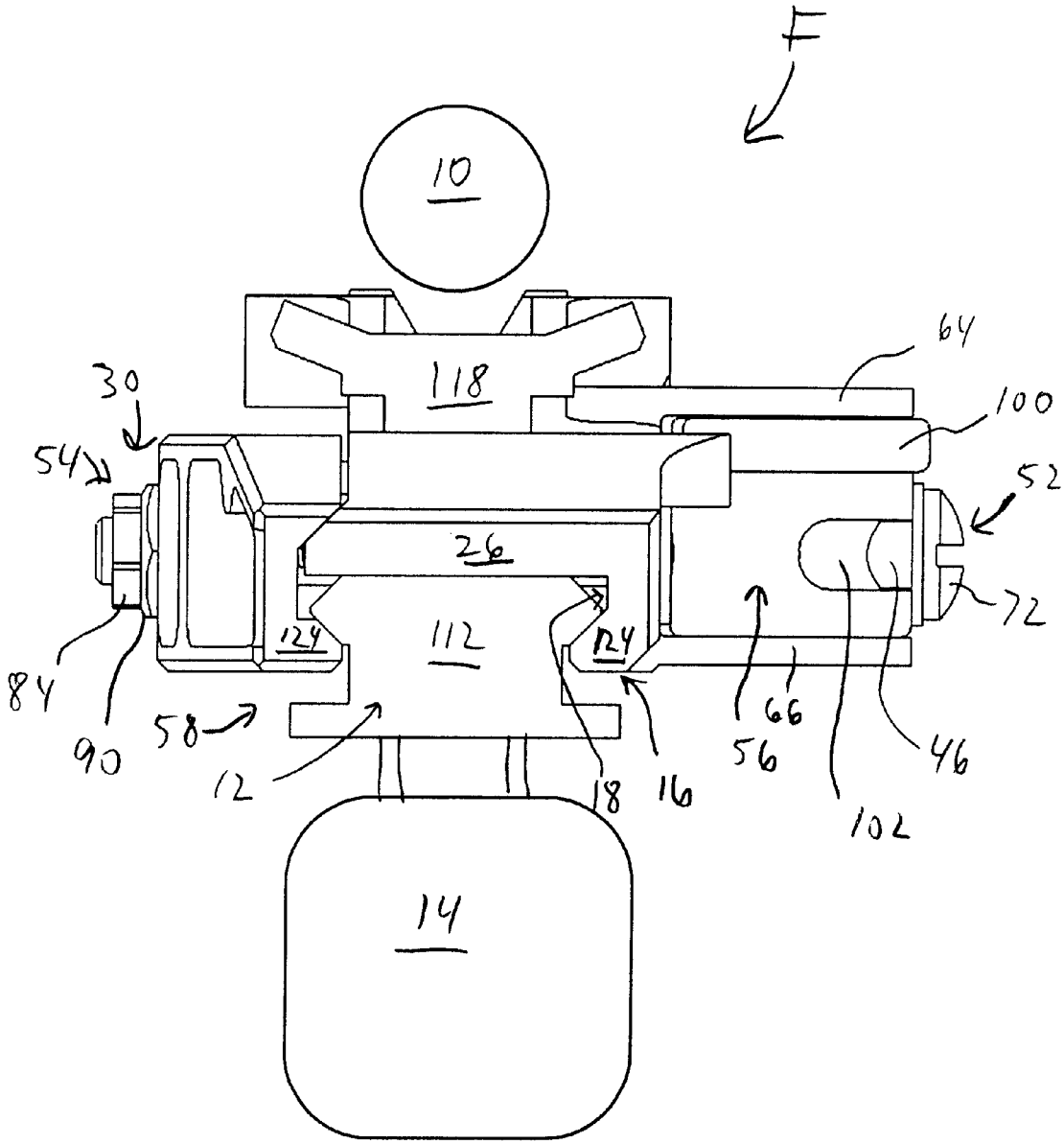
FIG. 4 is an elevational view from the front showing the present invention attached about a known type (US MIL-STD-1913) of mating rail.

The fastening device (F) of the present invention for attaching a selected first device (10) to a mounting or mating rail member (12) of a second device (14) includes a first side member (16) that has an interior surface (18) and an exterior surface (20), an upper longitudinal edge (22) and lower-longitudinal edge (24), and a first front edge (26) and second rear edge (28). Similarly, a second side member (30) has an interior surface (32) and an exterior surface (34), an upper longitudinal edge (36) and lower longitudinal edge (38), and a first front edge (40) and second rear edge (42). A top section (44) extends between the first (16) and second sides (30) and from either the first (16) or second side (30) near the respective upper longitudinal edges (22 and 36). The top section (44) may be formed having at least one V interface (126) adapted to mount and align the first device (10) (see FIG. 4).

The first (16) and second sides (30) are also adapted to clamp about at least a portion of the mating rail member (12) with the mating rail member (12) being removably secured between the interior surfaces (18 and 32 respectively) of the first and second sides (16 and 30). A clamping rod or member (46) extends between the first and second sides (16 and 30). The clamping member or bolt (46) has an extended end (48) and an opposing engaged end (50) with the extended end (48) of the clamping member (46) having a portion (52) of the clamping member extending through the first side (16). The engaged end (50) of the clamping member includes a portion (54) of the clamping member that is coupled with the second side (30).

Figure 1:
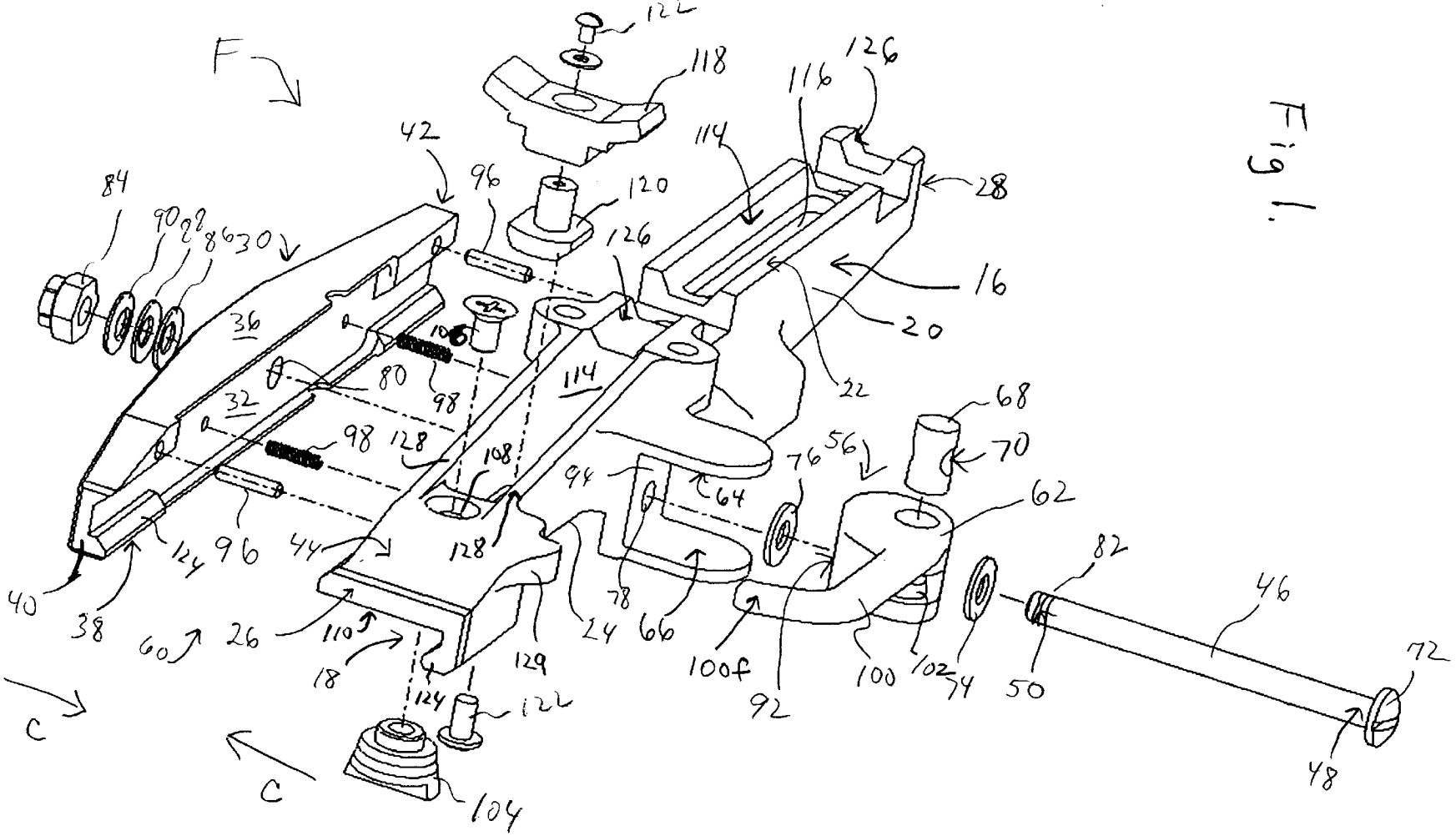
FIG. 1 is both a right front isomeric view and an exploded view of the attachment device of the present invention.
Figure 2:
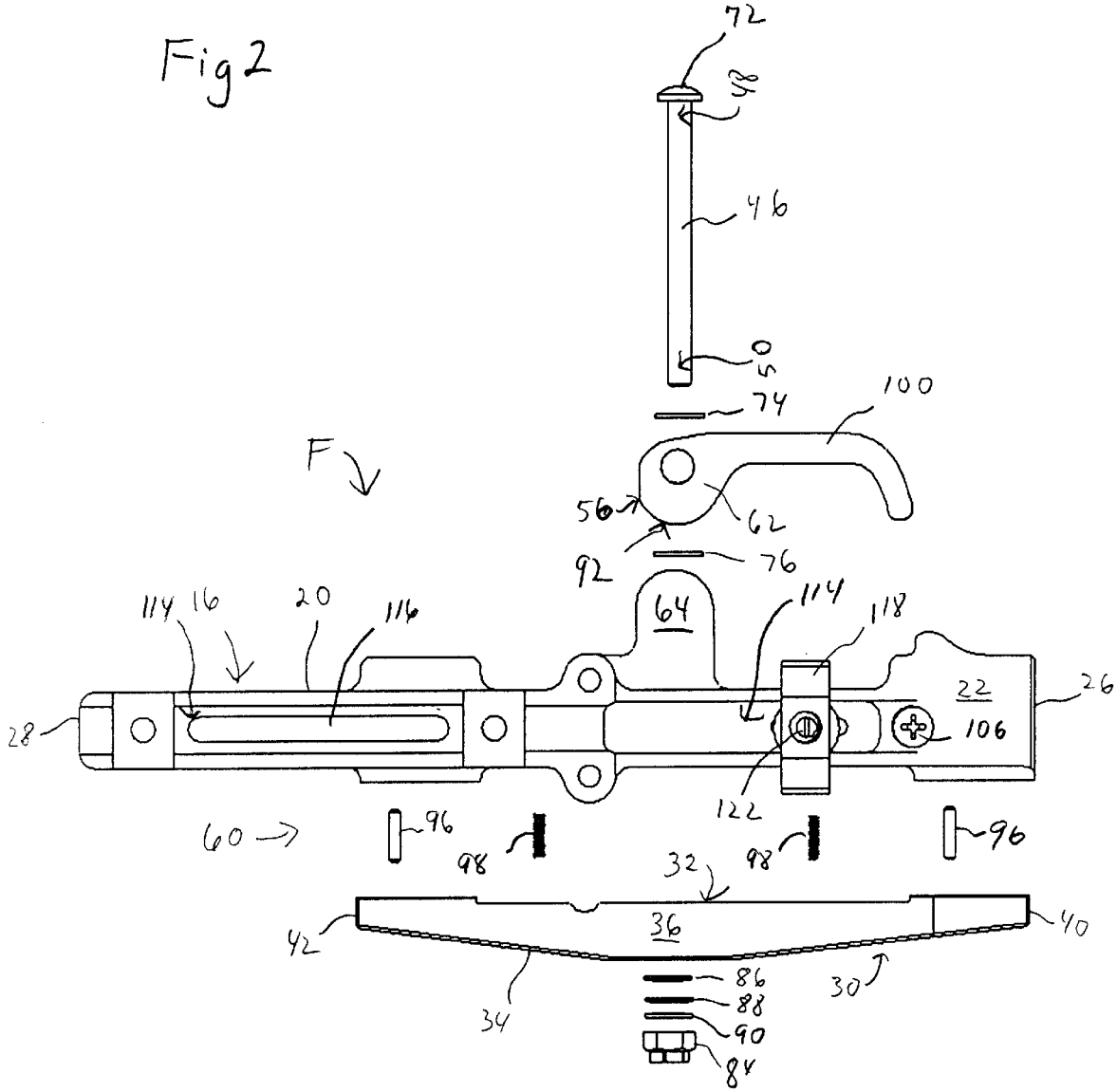
FIG. 2 is a plan view from the top.
Figure 3:
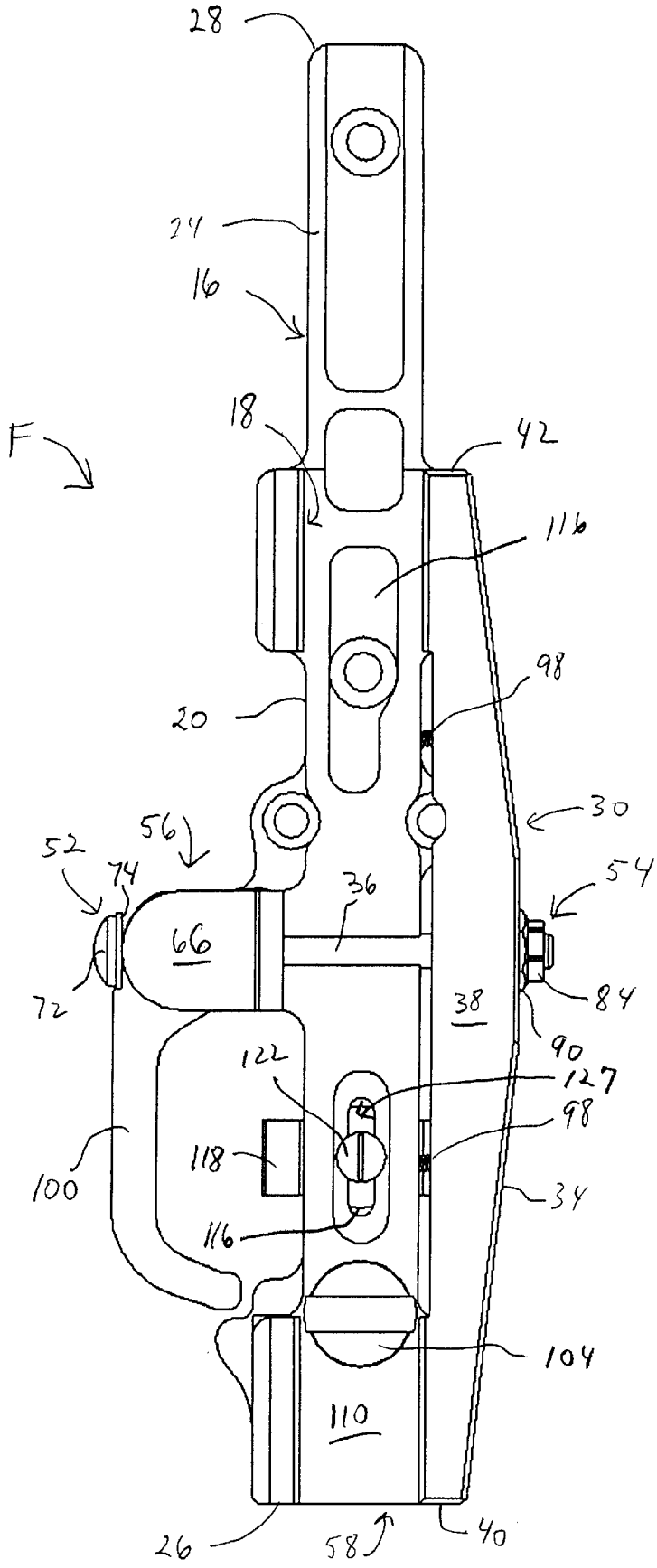
FIG. 3 is a bottom plan view.

The extended end part (48) of the clamping member is movably coupled to a single cam member (56) that is operably mounted with the first side (16) for drawing the first and second sides (16 and 30) closer together into a clamping position (58) (see FIGS. 3 and 4) from an extended or open position (60) (schematically shown in FIGS. 1 and 2). When the present fastening device (F) is in the clamping position (58) the first and second side members (16 and 30) will mate with the desired mating rail (12) and secure the fastening device (F) to the mounting rail (12).

The cam member (56) generally comprises a pivotally mounted hub (62) coupled between and upper surface or ear (64) and lower surface or ear (66). The hub (62) pivots about pivot pin (68) having a passage (70) therethrough to communicate the extended end (48) of the clamping member (46). The bolt screw head (72) cooperating with flat washer (74) retains the cam member (56). The clamping bolt (46) extends through the cam hub (62) and another flat washer (76) before entering a hole or passage (78) through the first side member (16).

The clamping member (46) extends between the interior surfaces (18 and 32) of the first and second side members (16 and 30 respectively). Similarly, the engaged end (50) of the clamping member (46) extends through a passage (80) through the second side member (30). Preferably, the engaged end (50) of the bolt (46) is formed having threads (82) to engage and secure a threaded compatible nut (84) or other known retaining mechanism. Optionally, additional flat or spring or compression type of washers (86, 88 and 90) can be placed between the nut (84) and the exterior surface (34) of the second side (30). The means of adjusting the clamping load or clamping force (C) exerted by the side members of the fastening device (F) upon the mounting rail (12) when in the clamping position (58) can be customized to a particular recoil level by adding or subtracting the number of spring washers (86, 88 and 90), changing the spring force of each individual spring, or adjusting engagement between nut (84) and engagement end (50).

When the components of the fastening device (F) are assembled, the first and second sides (16 and 30) and the cam member (56) are secured along the length of the clamping screw (46) between the bolt head (72) and nut (84).

The cam member (56) generally is disposed at or near the center along the longitudinal length of the first side (16) between the front (26) and rear (28) edges. The cam member (56) includes a camming surface (92) such that when the cam member (56) is selectively rotated, the cam member (56) cooperates with camming surface or face (94) formed with the exterior surface (20) of the first side (16).

Desirably, at least one alignment or guide pin (96) and at least one return spring (98) extends between the interior surfaces (18 and 32) of the first and second sides (16 and 30 respectively) to keep the first and second sides in proper alignment during operation of the cam member (56). Similarly, at least one return spring (98) extends between the interior surfaces (18 and 32) of the first and second sides (16 and 30 respectively) to assist separating the first and second sides during operation of the cam member (56) when the attachment device (F) is being taken out of the clamping position (58) disengaging the attachment device (F) from the mating rail (12).

The hub (62) of the cam member (56) can be formed having a handle (100) extending from the cam hub (62). When the attachment device (F) is assembled, turning of the handle (100) rotates the camming surface (92) of the hub (62) to push the pivot pin (68) further away from the first side (16). This causes the pulling of an additional amount of the extended end (48) of the clamping bolt (46) through the passage (78). Since the engaged end (50) of the clamping screw (46) secures the second side (30), the second side (30) is thereby drawn closer to the first side (16) and into the clamping position (58). Also, as the cam hub (62) rotates, the extended end (48) or the bolt head (72) travels through a groove (102) formed in the periphery of the hub (62). To minimize the inadvertent opening of the cam by foreign objects, such a brush or tree limbs, a smooth protective shield or snag protector (129) may optionally be incorporated or formed in the exterior surface (20) of the first side (18) in the proximity of a front segment (**100*f*) of the handle (100) when in the closed position (58**).

Also, to minimize the affect of the recoil from discharging a weapon upon the attachment device (F), a recoil stop (104) extends from the lower interior surface (110) of the top section (44), and may be attached to the top section (44) by a screw (106) extending through a hole or passage (108) in the top section (44) or any other of known means to affix the recoil stop (104) to the top section (44). The recoil stop (104) minimizes the movement of the detachment device (F) by abutting against the front (112) of the mating rail (12) or mate with a slot or indentation formed in the mating rail (12).

The top section (44) may be formed having grooves (114) and slots (116) for assisting the attachment or mounting of the first device (10). A mounting support (118) cooperating with a support lock (120) is removably secured to the top section (44) by screws (122) or other suitable means. The mounting support (118) supports a first device (10) at a desired height above the top section (44). Moving support lock (120) within grooves (114) via adjustment slot (127), the mounting support is adjusted both vertically and horizontally as mounting support slides along an angled surface or ramp (128). Large objective optics will benefit from such support during weapon recoil shock.

The bottom or lower edges (24 and 38) of the first and second sides (16 and 30 respectively) may further include lugs (124) extending from the interior surfaces for securing the mounting rail (12) between the lugs (124) and the lower surface (110) of the top section (44) when the fastening device (F) is in the clamping position (58).

The component parts of the fastening device (F) of the present invention are made from conventional materials. The body of the fastening device (F), such as the first and second sides (16 and 30), the top section (44) and the cam member (56) can be formed from a plastic, composite, resin, metal or anything else having a suitable strength, durability, desired sound deadening, or other selected characteristic. The springs (98) are generally formed from a known resilient metal alloy.

Typical of the first devices (10) that can be attached to the present fastening device (F) include optical weapon sights, cameras, telescopes, sensors, and other similar types an styles of mechanisms. Similarly, the second device can be a weapon, such as a rifle, or even a fixed position such as a building or rigid bench having a suitable mating rail attached for mounting the present fastening device (F).

Operation

To operate the attachment device (F), an operator positions the first side (16) and second side (30) about either longitudinal sides of a mounting rail (12). With the recoil stop (104) engaged in the selected slot of the mounting rail (12), the fastening device (F) is slid forward to ensure tolerance slack between recoil stop (104) and mounting rail (12) is removed. The operator then rotates the cam member (56) in the direction that pulls a greater length of the extended end (48) of the clamping screw (46) through the passage (78) in the first side (16). This actions brings the first side (16) and the second side (30) closer together and into the clamping position (58) about the mating rail (12).

The foregoing disclosure and description of the invention are illustrative and explanatory thereof, and various changes in the size, shape and materials, as well as in the details of the illustrated construction may be made without departing from the spirit of the invention.

What is claimed is:

1. A fastening device for attaching a selected first device to a mounting rail member of a second device, the invention comprising:

a first side member having an interior and an exterior surface, upper and lower longitudinal edges, and a first frontal edge and a second rearward edge;

a second side member having an interior and an exterior surface, upper and lower longitudinal edges, and first and second edges;

a top section extending from the first or second sides near the respective upper longitudinal edge; the top section being adapted to mount the first device;

the first and second sides being adapted to clamp about at least a portion of the mating rail member with the mating rail member being removably secured between the interior surfaces of the first and second sides;

a clamping member extending between the first and second sides; the clamping member having an extended end and an opposing engaged end; the extended end of the clamping member includes a portion of the clamping member extending through the first side; the engaged end of the clamping member includes a portion of the clamping member being coupled with the second side;

the extended portion of the clamping member being movably coupled to a single cam member operably mounted with the first side for drawing the first and second sides closer together into a clamping position to mate the first and second side members with the desired mating rail; and, a snag protector extending from the exterior surface of the first member in proximity to a front segment of the handle when the fastening device is in the clamping position.

2. The invention of claim 1 wherein the cam member is formed having a handle extending therefrom.

3. The invention of claim 2 wherein the fastening device moves into the clamping position by rotating the handle of the cam member in the direction of the first edge of the first side member.

4. The invention of claim 1 further including a recoil stop element extends downwardly from the top section for securing the fastening device against recoil of the second device responsive a discharge by the second device.

5. The invention of claim 1 wherein the top section further includes an adjustable support and support locking member to support the first device at a desired height above the top section.

6. The invention of claim 1 wherein the cam member is centrally disposed along a longitudinal length of the first side.

7. The invention of claim 1 further including lugs extending from the interior surface in proximity to the lower longitudinal edges of the first and second side members for securing the mounting rail between the lugs and a lower surface of the top section when the fastening device is in the clamping position.

8. The invention of claim 1 further including at least one alignment pin extending between the interior surfaces of the first and second side members for aligning the first and second side members when the fastening device is in the clamping position.

9. The invention of claim 1 further including return spring means extending from the interior surface of the first or second side members for assisting the separation of the first and second side members for ease of installation about the mounting rail.

10. The invention of claim 1 wherein the clamping member further includes an adjustment means to adjust a force applied to the mounting rail by the opposing side members when the fastening device is in the clamping position.

11. A method of using a fastening device for attaching a selected first device to a mounting rail member of a second device, the invention comprising the steps of:

operating a single cam member mounted with a first side member for drawing the first side member and a second side member closer together into a clamping position to mate the first and second side members with the desired mounting rail;

the first side member having an interior and an exterior surface, upper and lower longitudinal edges, and a first frontal edge and a second rearward edge;

the second side member having an interior and an exterior surface, upper and lower longitudinal edges, and first and second edges;

a top section extending from the first or second sides near the respective upper longitudinal edge; the top section being adapted to mount the first device;

the first and second sides being adapted to clamp about at least a portion of the mounting rail member with the mounting rail member being removably secured between the interior surfaces of the first and second sides;

a clamping member extending between the first and second sides; the clamping member having an extended end and an opposing engaged end; the extended end of the clamping member includes a portion of the clamping member extending through the first side; the engaged end of the clamping member includes a portion of the clamping member being coupled with the second side;

the extended portion of the clamping member being movably coupled to the single cam member; and, a snag protector extending from the exterior surface of the first member in proximity to a front segment of the handle when the fastening device is in the clamping position.

12. The method of claim 11 wherein the cam member is formed having a handle extending therefrom.

13. The method of claim 11 wherein the clamping member further includes an adjustment means to adjust a force applied to the mounting rail by the opposing side members when the fastening device is in the clamping position.

14. The method of claim 11 wherein the cam member is centrally disposed along a longitudinal length of the first side.

* * * * *